US009964065B2

(12) United States Patent
Cook et al.

(10) Patent No.: US 9,964,065 B2
(45) Date of Patent: May 8, 2018

(54) GENERAL PURPOSE ENGINE

(71) Applicant: Kawasaki Jukogyo Kabushiki Kaisha, Kobe-Shi, Hyogo (JP)

(72) Inventors: Jakob Daniel Cook, Ada, MI (US); Alexander Uldis Sics, Grand Rapids, MI (US)

(73) Assignee: KAWASAKI JUKOGYO KABUSHIKI KAISHA (JP)

( * ) Notice: Subject to any disclaimer, the term of this patent is extended or adjusted under 35 U.S.C. 154(b) by 68 days.

(21) Appl. No.: 14/958,063

(22) Filed: Dec. 3, 2015

(65) Prior Publication Data

US 2017/0159600 A1 Jun. 8, 2017

(51) Int. Cl.

| | |
|---|---|
| ***F02F 1/06*** | (2006.01) |
| ***F02M 35/024*** | (2006.01) |
| ***F02F 1/34*** | (2006.01) |
| ***F02M 35/02*** | (2006.01) |
| ***F01P 1/02*** | (2006.01) |
| ***F01P 11/12*** | (2006.01) |
| ***F02B 77/04*** | (2006.01) |

(52) U.S. Cl.

CPC ..... *F02F 1/065* (2013.01); *F01P 1/02* (2013.01); *F01P 11/12* (2013.01); *F02B 77/04* (2013.01); *F02F 1/34* (2013.01); *F02M 35/0201* (2013.01); *F02M 35/024* (2013.01)

(58) Field of Classification Search

CPC ..... F02F 1/065; F02F 1/34; F02F 1/28; F02F 1/26; F02F 1/04; F02F 1/02; F02F 7/00; F02F 7/0012; F01P 1/02; F01P 11/12; F01P 2001/023; F02M 35/024; F02M 35/0201

USPC ..... 123/198 E, 195 C, 41.56

See application file for complete search history.

(56) References Cited

U.S. PATENT DOCUMENTS

| | | | | |
|---|---|---|---|---|
| 4,156,409 | A * | 5/1979 | Nakano | F01P 5/06 123/192.2 |
| 5,813,384 | A * | 9/1998 | Lavender | F02B 75/22 123/184.32 |
| 5,934,240 | A * | 8/1999 | Yokocho | F02B 63/02 123/195 C |
| 6,889,635 | B2 * | 5/2005 | Geisheker | F01P 1/02 123/198 E |
| 7,363,885 | B2 * | 4/2008 | Miyake | F01P 1/02 123/185.3 |
| 7,389,760 | B2 * | 6/2008 | Fogolini | F02F 7/006 123/195 C |
| 7,950,355 | B2 * | 5/2011 | Nakamizo | F01P 11/12 123/41.67 |
| 9,388,731 | B2 * | 7/2016 | Le Roy | F04D 29/582 |
| 9,500,117 | B2 * | 11/2016 | Sullivan | F01P 5/02 |
| 2004/0025827 | A1 * | 2/2004 | Davis | B01D 46/0004 123/198 E |

(Continued)

*Primary Examiner* — Grant Moubry

(57) ABSTRACT

A general purpose engine with a cleaning access window defined therein is in the form of an air cooled engine, having a cylinder unit made up of a cylinder and a cylinder head, and includes a housing for covering at least the cylinder unit and a cleaner covering removably fitted to the housing for covering the filter section of the air cleaner, the housing being formed with a blow window so as to confront gaps between a plurality of cooling fins provided in the cylinder unit, and the cleaner covering has a closing section defined therein for covering the blow window.

8 Claims, 9 Drawing Sheets

(56) References Cited

U.S. PATENT DOCUMENTS

2006/0169256 A1* 8/2006 Lavender ..... F01P 5/06
123/559.1

* cited by examiner

GENERAL PURPOSE ENGINE

BACKGROUND OF THE INVENTION (Field of the Invention)

The present invention relates to a general purpose or versatile engine having a cleaning access window defined therein, which engine is used as a drive source in a working machine such as, for example, a lawn mower.

Description of Related Art

For a drive source in a working machine such as, for example, a lawn mower, a compact air cooled general purpose engine is generally employed. When the use of such a working machine for a certain period of time is continued, mowed grasses may often be heaped up as a refuse in gaps between cooling fins around a cylinder and/or a cylinder head, both of which are component parts of the engine, to such an extent as to result in clogging that eventually results in the loss of the cooling function of the engine.

For this reason, a work to remove the refuse heaped up in the gaps between the cooling fins is regularly or occasionally carried out. On the other hand, since a filter section, where a cleaner element of the air cleaner is held, is also susceptible to clogging, regular or occasional maintenance such as, for example, cleaning or replacement is needed. In view of this, the conventional engine of this kind is so configured that the air cleaner is removably accommodated within a recess defined in a housing and that the housing is provided with a blow opening, which faces the gaps between the plurality of the cooling fins. The recess is then covered by a cleaner covering that is movable between opened and closed positions, and the blow opening is closed by a lid member that is removably mounted. Accordingly, for example, such a routine has been required that the maintenance such as replacement of the filter section of the air cleaner is carried out with the cleaner covering having been opened and the work to remove the refuse then clogging in the cooling fins is accomplished by opening the lid member then covering the blow opening to allow a blowing work with the use of a compressed air from the blow opening to be performed.

As discussed above, the conventional engine construction requires that since the lid member for covering the blow opening and the cleaner covering are members separate from each other and since mounting and removal of the lid member is therefore required as a work separate from fitting and removal of the cleaner covering, the blow workability is low and, since the number of component parts is many, the cost is hence high.

DISCLOSURE OF THE INVENTION

In view of the foregoing, the present invention has for its primary object to provide an air cooled general purpose engine having a cleaning access window defined therein, which engine is expected to have a reduced number of component parts used and an increase of the blow workability because the cleaner covering for covering the air cleaner and the lid member for closing the blow opening are integrated together.

In order to accomplish the foregoing object, the general purpose engine designed in accordance with the present invention is an air cooled general purpose engine with the cleaning access window defined therein, which engine includes a cylinder unit made up of a cylinder and a cylinder head. This general purpose engine also includes a housing to cover at least the cylinder unit referred to above, and a cleaner covering mounted removably on the housing to cover a filter section of the air cleaner. The housing referred to above is formed with a blow window facing a plurality of cooling fins provided in the cylinder unit, and a closing section to close the blow window is formed in the cleaner covering. Here, the housing referred to above is such as to cover so that the cylinder unit is invisible from at least one direction, and the cylinder unit may not be covered when viewed from all directions.

In the conventional engine, in order to expose the blow window, a lid member dedicated for the blow window, which member is separate from the cleaner covering, has been necessarily removed. In contrast thereto, according to the above described construction, since during the maintenance of the filter section of the air cleaner the blow window is exposed simultaneously with the removal of the cleaner covering from the housing, the blow work can be facilitated in conjunction with the maintenance of the filter section of the air cleaner and, hence, the workability of the maintenance is increased. Also, since the use of the lid member dedicated for the blow window is dispensed with and the number of component parts is hence reduced, the cost can be reduced.

According to one preferred embodiment of the present invention, the general purpose engine is preferably in the form of a V-shaped two cylinder engine, in which case the filter section of the air cleaner is disposed between the two cylinder units. According to this construction, since the distance between the two cylinder units is reduced, compactization of the cleaner covering having a closing section for the blow window can be accomplished.

In the present invention, particularly where the general purpose engine is in the form of V-shaped two cylinder engine, the blow window is preferably formed for and in each of the cylinder unit so as to confront the respective cylinder unit. According to this construction, the blow work effective for each cylinder unit can be enabled.

In the present invention, particularly where the general purpose engine is in the form of V-shaped two cylinder engine, an engine rotary shaft preferably extends vertically, in which case the two cylinder units are disposed horizontally. According to this construction, the blow work can be performed from above and, therefore, the workability increases.

In the present invention, the cleaner covering is preferably fitted to the housing by means of a fastener, in which case the fastener includes an engagement portion which is engaged with a to-be-engaged portion of the housing when in a condition having been inserted in the cleaner covering the fastener is turned a predetermined angle. According to this construction, removal and fitting operation of the cleaner covering relative to the housing is made easy.

In the present invention, the to-be-engaged portion of the housing is preferably made up of an engagement recess, at which the turn of the fastener causes the engagement portion of the fastener to climb over and be accommodated at a lock position, and a stopper to inhibit the turn of the engagement portion further beyond the lock position. The use of the engagement recess and the stopper, both referred to above, is effective to allow the fastener to fit the cleaner covering stably.

In the present invention, the closing section of the cleaner covering preferably includes a mounting protrusion engaged in the blow window of the housing. According to this construction, since through the engagement between the blow window and the mounting protrusion the positioning of the cleaner covering relative to the housing is facilitated, the fitting of the cleaner covering is facilitated.

In the present invention, the filter section is preferably capable of being removed in a separating direction of the cleaner covering in a condition in which the cleaner covering has been separated. According to this construction, since there is generally no obstruction in the separating direction of the cleaner covering, the filter section is easily removed in the same direction as that separating direction and, therefore, a work to replace the filter section is facilitated.

In the present invention, the closing section of the cleaner covering preferably has an outer surface applied with a marking indicative of the blow window. According to this construction, since the marking provides an eye mark that can be ascertained easily from the outside, the position of the blow window is instantaneously recognized upon viewing the marking with naked eyes and, therefore, the blow work subsequent to the removal of the cleaner covering is facilitated.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF PREFERRED EMBODIMENTS

Figure 1:
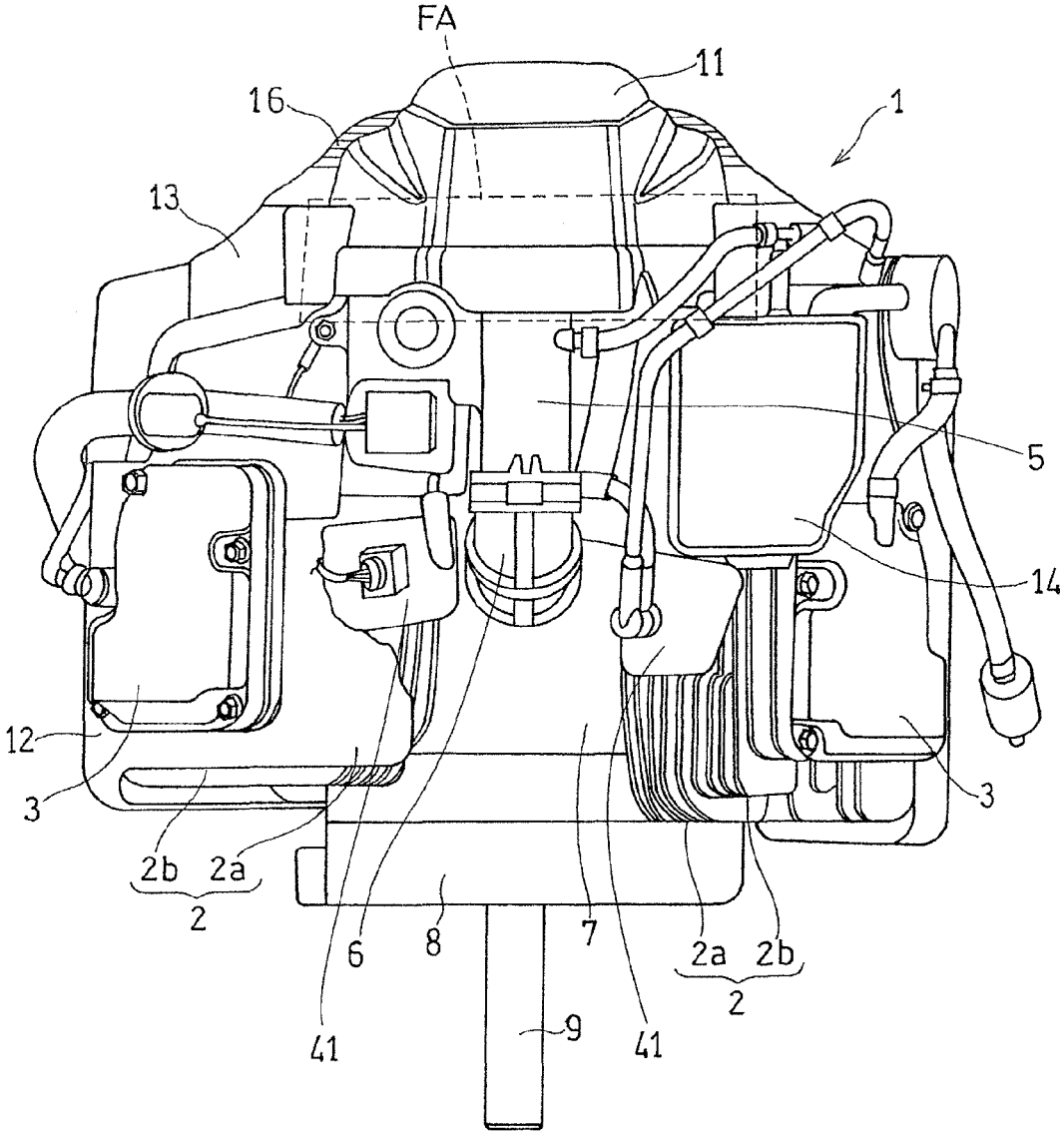
FIG. 1 is a schematic front elevational view, a schematic structure of a general purpose engine designed according to a preferred embodiment of the present invention.

A preferred embodiment of the present invention will be described in detail with particular reference to the accompanying drawings. In particular, FIG. 1 illustrates a schematic structure of a general purpose engine designed in accordance with the preferred embodiment of the present invention, which engine is shown in a schematic front elevational view. The general purpose engine, generally identified by 1 in FIG. 1, is a compact, air cooled two cycle engine and is used as a drive source for a working machine such as, for example, a lawn mower.

Figure 3:
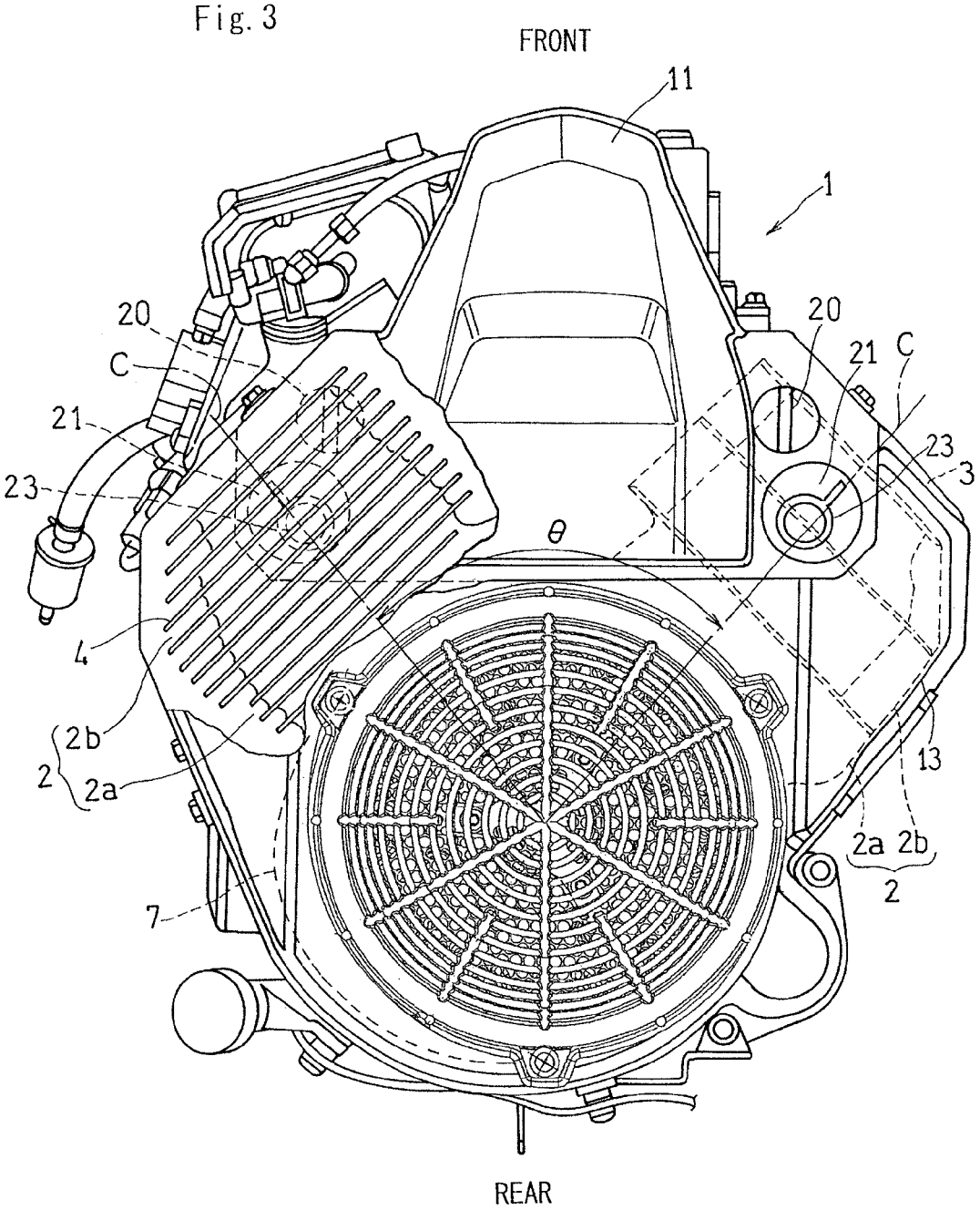
FIG. 3 is a top plan view, with a portion broken away, showing the general purpose engine.

As FIG. 3 makes it clear, the general purpose engine 1 is a V-shaped two cylinder engine which includes left and right cylinder units 2 and 2, each made up of a cylinder 2*a* and a cylinder head 2*b*, which units 2 and 2 are arranged in V-shape. The cylinder units 2 and 2 have respective cylinder axes C and C set at an angle θ which is generally within the range of 70 to 100 degrees, and are set to an angle of 90 degrees relative to each other in the instance embodiment now under discussion. Respective apexes of those cylinder units 2 and 2 are covered by corresponding head coverings 3 and 3 shown in FIG. 1. Each of the cylinder units 2 has its outer periphery formed with a plurality of cooling fins 4.

Figure 2:
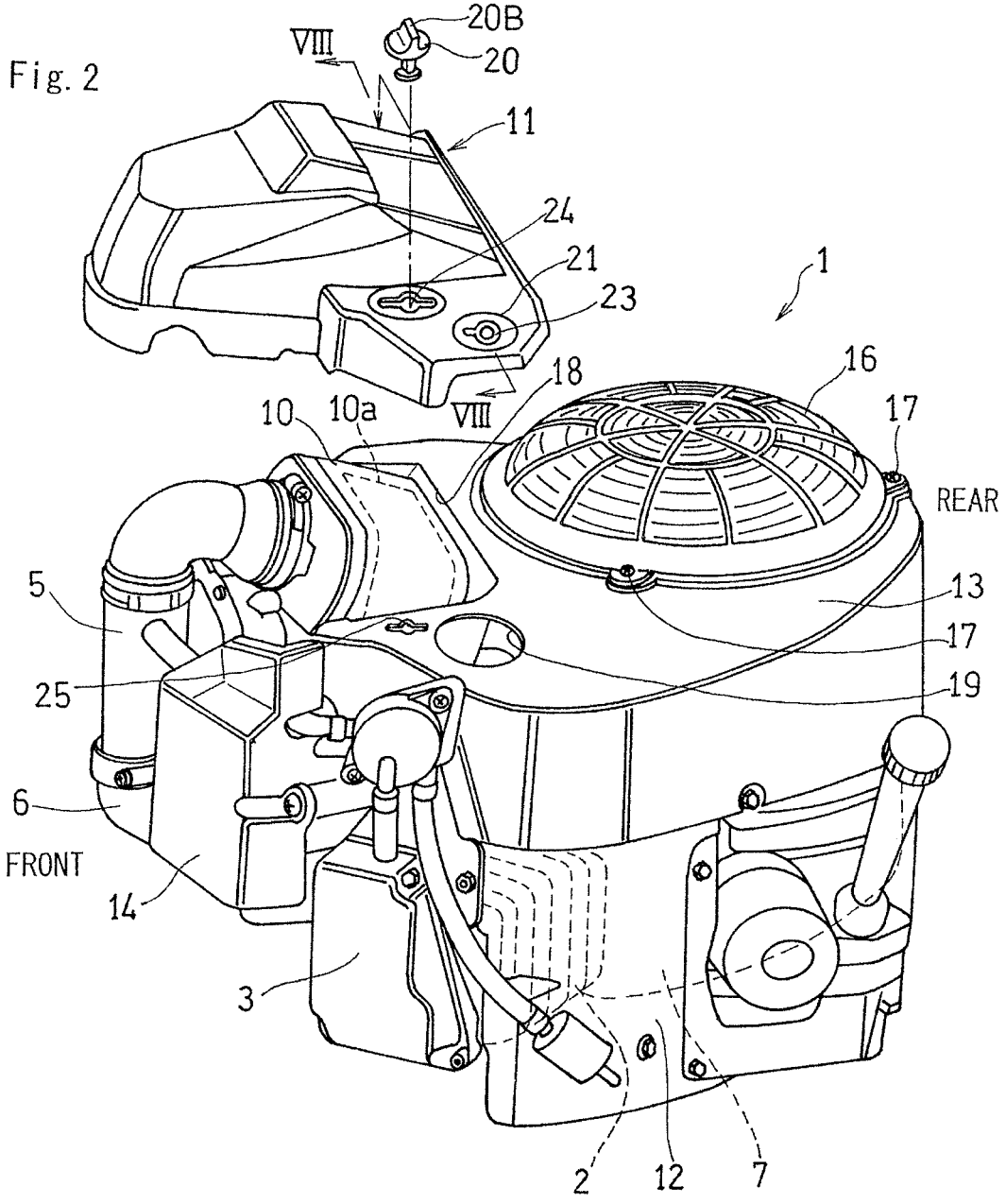
FIG. 2 is an exploded view of the general purpose engine.

Between the cylinder units 2 and 2, an air regulating device 5, an air cleaner 10 shown in FIG. 2 and a fuel supply unit 14 are disposed. A fuel is pumped by the fuel supply unit 14 to be injected from fuel injectors 41 and 41 into a manifold 6 where the fuel and air from the air cleaner 10 are mixed together to provide an air/fuel mixture, the resultant air/fuel mixture being subsequently supplied and distributed through the manifold 6 into the left and right cylinder units 2 and 2 shown in FIG. 1. The cylinder units 2 and 2 are connected to a single crankcase 7 and a base covering 8 is fitted to a lower end surface of such crankcase 7. A crankshaft (rotary shaft) 9 extends through the base covering 8 so as to protrude downwardly in a vertical direction.

As shown in FIG. 2, the air cleaner 10 disposed above the space delimited between the cylinder units 2 and 2 is covered from above by a cleaner covering 11. It may occurs that the air cleaner 10 of a size larger than that shown is available, and even in that case, the cleaner covering 11 is so formed to a size enough to cover at least a filter section 10*a*.

In FIG. 1 a cooling fan FA shown by the broken line is provided in an upper end portion of the crankshaft (rotary shaft) 9. The crankcase 7 of the engine 1 has its outer periphery covered by a shroud 12 and an upper portion thereof is covered by a fan housing 13. As FIGS. 2 and 3 make it clear, the fan housing 13 covers the cylinder units 2 and 2 from axially above of the rotary shaft 9 to allow the cylinder units 2 and 2 and the crankcase 7 to be invisible from above. The housing 13 may be so formed as to cover only the cylinder units 2 and 2 and the crankcase 7 may be covered by a separate casing. Also, the housing 13 may not necessarily be covered from above and, in the case of the engine in which the rotary shaft 9 is disposed horizontally, the cylinder unit may be so covered that front and rear surfaces forming respective parts of the outer peripheral surface of the cylinder unit may be invisible. The shroud 12 shown in FIG. 2 is bolted to an engine main body including the cylinder units 2 and 2 and the crankcase 7 of the engine 1, and the fan housing 13 is bolted to the crankcase 7.

The shroud 12 and the fan housing 13 may be formed by an integrated, single housing. In the description that follows, the fan housing 13 may be occasionally referred to simply as "housing". A portion of the fan housing 13 which axially faces the cooling fan FA is formed with an opening 15, best shown in FIG. 5, which opening 15 is covered by a fan covering 16 having a plurality of ventilation slits defined therein. This fan covering 16 is fitted to the housing 13 by means of a plurality of fastening members 17.

Figure 4:
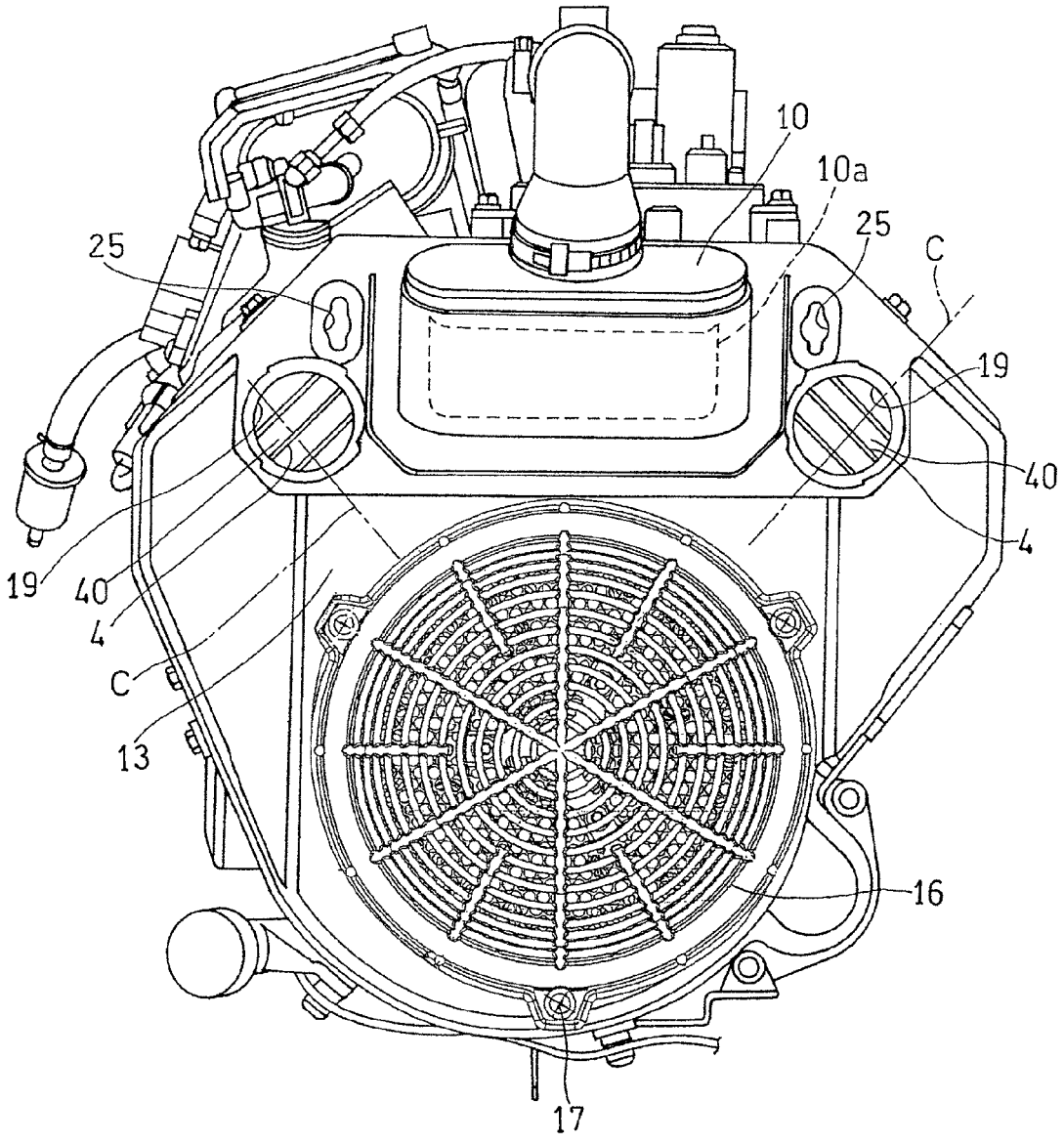
FIG. 4 is a top plan view showing the general purpose engine in a condition with a cleaner covering removed.

As shown in FIG. 2, when the cleaner covering 11 is removed from the housing 13, the air cleaner 10 is exposed upwardly. The air cleaner 10 is accommodated within a storage recess 18 formed in the housing 13, and the manifold 6 referred to previously is fluid connected with an outlet of the air cleaner 10. The air cleaner 10 has a filter section 10*a* within a casing, and the air sucked from around the air cleaner 10 is, after having been purified by the filter section 10*a*, introduced into the manifold 6. The housing 13 has a pair of blow windows 19 defined therein. As shown in FIG. 4 showing the condition in which the cleaner covering 11 is removed, each of the blow windows 19 confronts a plurality of cooling fins 4, provided in each of the two cylinder units 2 and 2, and gaps 40 each defined between the neighboring cooling fins 4. The cooling fins 4 extend in a direction perpendicular to each of cylinder axes C.

The cleaner covering 11 shown in FIG. 2 is provided with insertion holes 24 and 24 for the passage of a pair of fasteners 20 and 20, as will be detailed later, and is also integrally formed with closing sections 21 and 21 for closing the blow windows 19. The housing 13 is formed with mounting holes 25 and 25 into which the fasteners 20 are respectively inserted. The pair of the insertion holes 24 and 24 are each provided in a somewhat forward side of both of base end portions of the cleaner covering 11, and the closing sections 21 are each provided in a somewhat rearward side of the associated fastener insertion hole 24 at both of the base end portions of the cleaner covering 11 and at a position corresponding to the blow window 19. Each of the closing section 21 has an outer surface on which a marking 23 as a visible indication representative of an open position of the corresponding blow window 19 is applied in a fashion visible from the outside with eyes.

Figure 5:
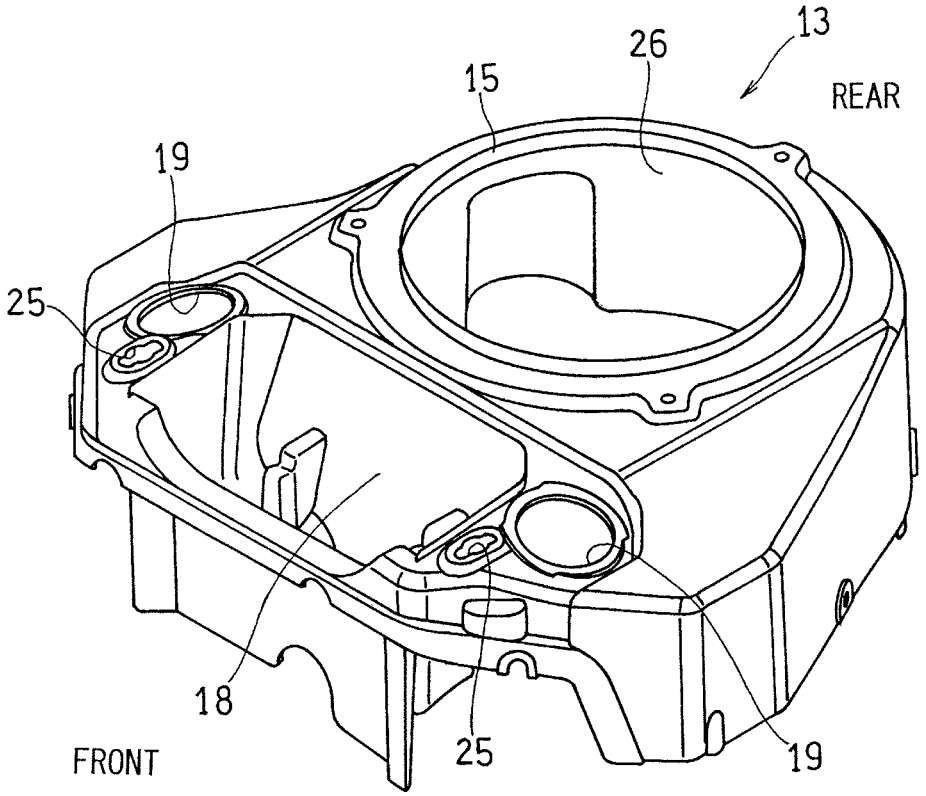
FIG. 5 is a perspective view showing a housing for the general purpose engine.
Figure 6:
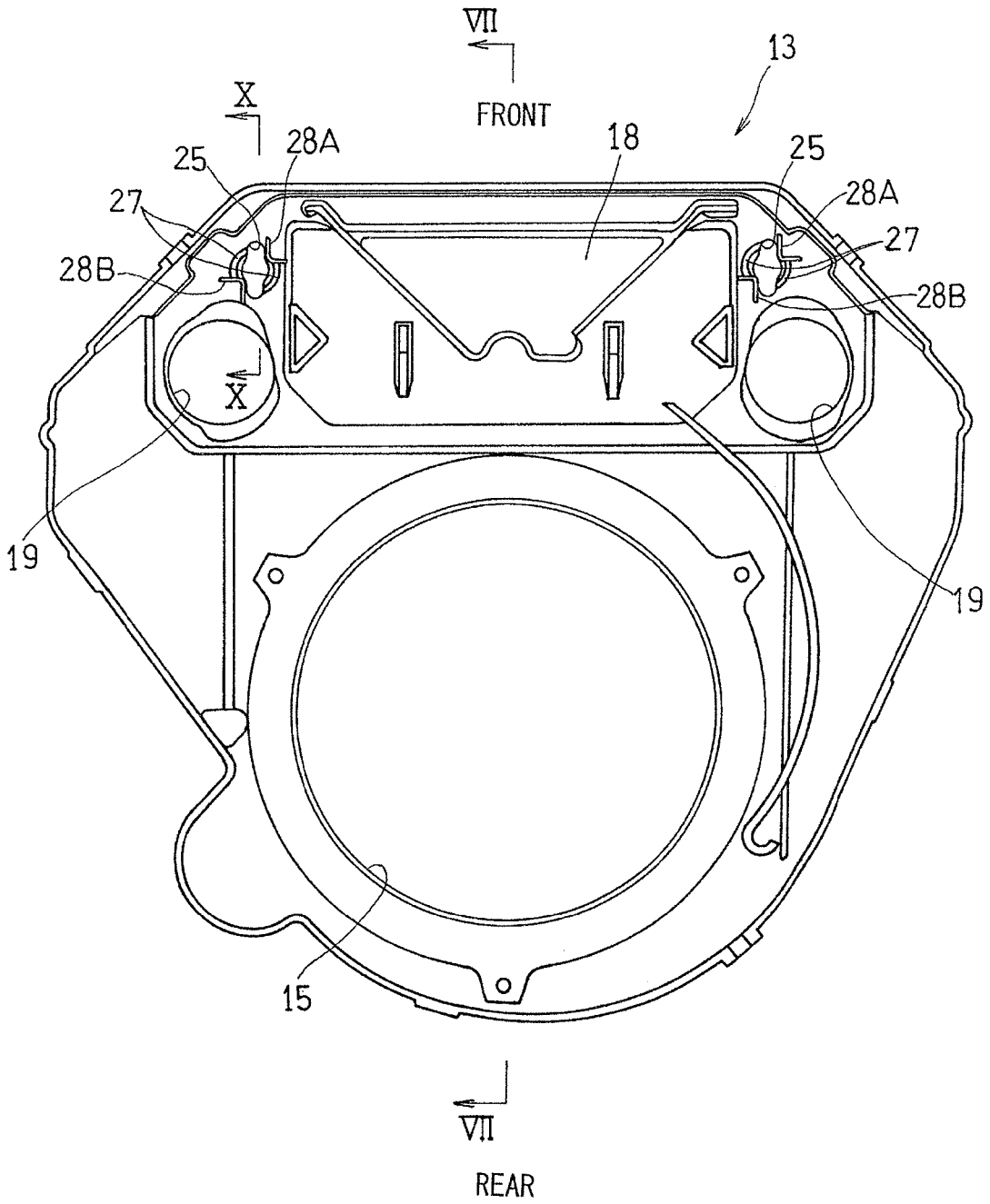
FIG. 6 is a schematic bottom plan view showing the housing for the general purpose engine.

As shown in FIG. 5, the housing 13 is formed as a one piece member object and is made of a synthetic resin by the use of a molding technique and has the fan accommodating portion 26 defined therein for accommodating the cooling fan FA shown in FIG. 1. This housing 13 also has the storage recess 18 defined therein for accommodating the air cleaner 10. As shown in FIG. 6 showing a bottom plan view of the housing, a peripheral edge of each of mounting holes 25 and 25 in the housing 13 is formed with a to-be-engaged portion 27, a stopper 28A of a shape similar to the shape of a figure "L" and a stopper 28B of a shape similar to the inverted shape of the figure "L" so as to protrude inwardly of the housing 13.

Figure 7:
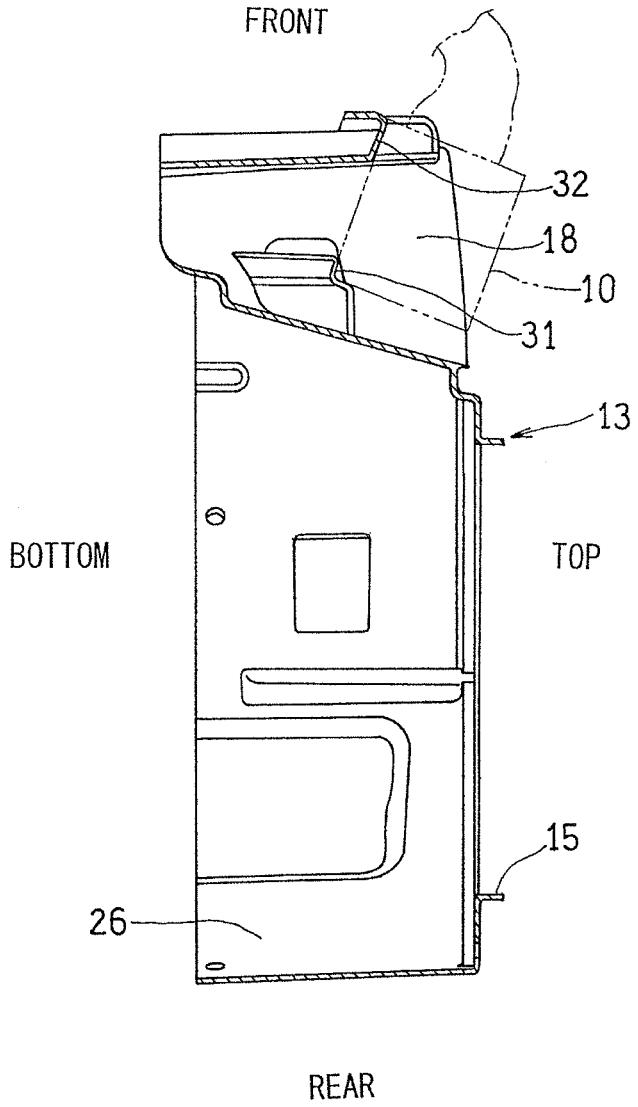
FIG. 7 is a cross sectional view taken along the line VII-VII in FIG. 6.

As shown in a sectional shape of FIG. 7, the storage recess 18 in the housing 13 has a bottom portion open with a first support base 31 formed in an inner surface thereof and also with a second support base 32 formed in a front edge thereof. A lower portion of an inner end portion of the air cleaner 10 is supported by the first support base 31 and a lower portion of an outer end portion thereof is supported by the second support base 32.

Figure 8:
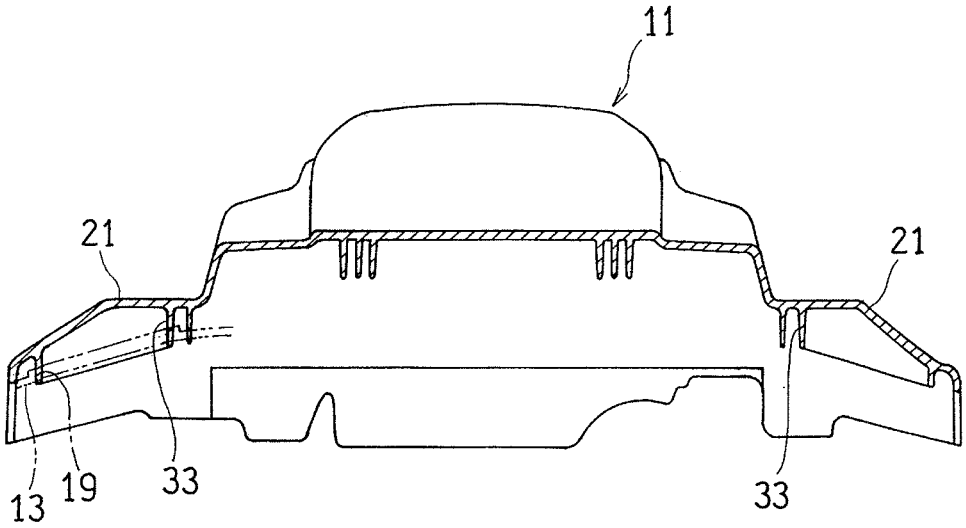
FIG. 8 is a cross sectional view taken along the line VIII-VIII in FIG. 2.

As shown in a sectional shape of FIG. 8, the closing section 21 of the cleaner covering 11 is formed with a mounting protrusion 33, such as a barrel, so as to protrude inwardly. When the cleaner covering 11 is held in position to cover the housing 13 best shown in FIG. 2, the mounting protrusion 33 best shown in FIG. 8 is mounted on the blow window 19 in the housing 13. With the mounting protrusion 33 mounted on the blow window 19 as discussed above, the positioning of the cleaner covering 11 relative to the housing 13 is facilitated.

Figure 9:
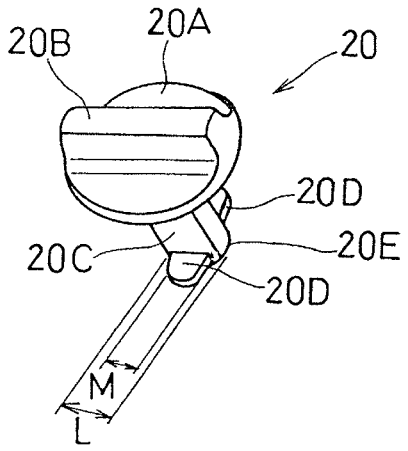
FIG. 9 is a perspective view showing, on an enlarged scale, a fastener for a cleaner covering in the general purpose engine.

The fastener 20, shown in FIG. 2, which is mounted on the cleaner covering 11 includes, as shown in FIG. 9, a disc shaped base plate 20A, a grip portion 20B of a convex shape provided in a front surface of the disc shaped base plate 20 so as to protrude in one direction, which is a diametrical direction, a shank portion 20C extending downwardly from a rear surface of the base plate 20A, and engagement portions 20D and 20D provided on respective opposite sides of a lower end portion 20E of the shank portion 20C. The engagement portions 20D and 20D provided in the lower end portion 20E referred to above lie in a direction different 90° from the one direction of the grip portion 20B. The lower end portion 20E of the shank portion 20C has a transverse width L somewhat greater than the transverse width M of each of the engagement portions 20D and 20D. The fastener 20 of the above described construction can be turned a predetermined angle (90°) when the grip portion 20B is turned while the shank portion 20C is inserted into the insertion hole 24 in the cleaner covering 11 shown in FIG. 2 and the mounting hole 25 in the housing 13.

Figure 10:
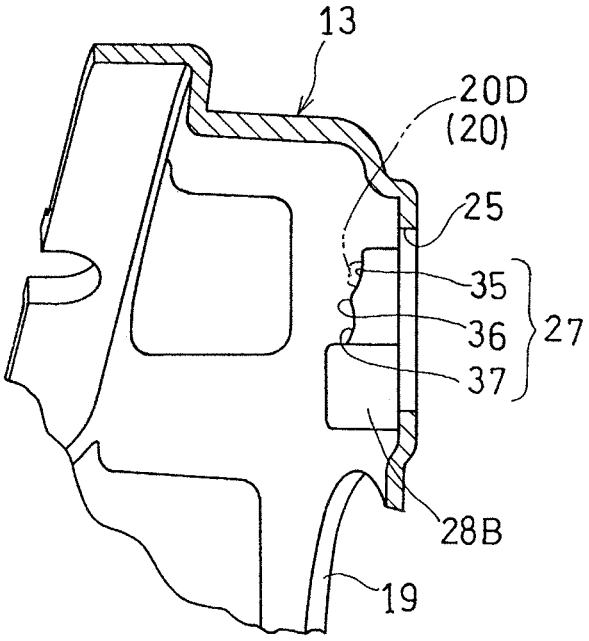
FIG. 10 is a cross sectional view taken along the line X-X in FIG. 6, showing the details of a to-be-engaged section of the housing.

As shown in FIG. 10, the to-be-engaged portion 27 around the peripheral edge of the mounting hole 25 in the housing 13 includes a guide recess 35 and an engagement recess 37 continued thereto through a heap portion 36 and having a height smaller than that of the heap portion 36. After the engagement portion 20D of the fastener 20 has been placed on the heap portion 36 in the housing 13, the fastener 20 is turned to climb over the heap portion 36 in FIG. 10 until it is placed over the engagement recess 37. By so doing, the fastener 20 is engaged with the to-be-engaged portion 27 and this engaged condition is maintained by the heap portion 36 and the stopper 28B.

When the cleaner covering 11 shown in FIG. 2 is fitted to a predetermined site of the housing 13, the fastener 20 shown in FIG. 4 is engaged into the insertion hole 24 in the housing 13. Subsequently, the grip portion 20B set in a transverse direction is gripped and is then turned 90° and, by so doing, the grip portion 20B is oriented in a longitudinal direction as shown in FIG. 3. By so doing, as hereinbefore described, the engagement portions 20D and 20D of the fastener 20 shown in FIG. 9 are engaged with the to-be-engaged portion 27 with the cleaner covering 11 of FIG. 2 fixed consequently on the housing 13. When the fastener 20 is turned in a reverse direction, the engagement of the fastener 20 into the to-be-engaged portion 27 is released to bring the cleaner covering 11 in a condition ready to be removed.

Starting from this condition described above, the air cleaner 10 is separated upwardly from the housing 13 so that the maintenance such as cleaning of the filter section 10*a* or replacement of the filter section 10*a* can be carried out. Along therewith, a nozzle of a blower is inserted through the blow window 19 in the housing 13 shown in FIG. 4 to supply a compressed air thereinto to thereby remove refuse accumulated in the gaps 40 each between the neighboring cooling fins 4 and 4.

According to the above described construction, the engine 1 is of such a structure that the blow window 19 confronting the gaps 40 each delimited by the neighboring cooling fins 4 provided in the cylinder unit 2 is formed in the housing 13 covering the cylinder unit 2, as shown in FIG. 4. The closing section 21 shown in FIG. 3 for closing the blow window 19 in the cleaner covering 11 is provided in the cleaner covering 11. In other words, as shown in FIG. 2, since the closing section 21 for closing the blow window 19 is formed integrally with the cleaner covering 11, the blow window 19 is exposed to the outside simultaneously with the removal of the cleaner covering 11 from the housing 13 during the maintenance of the filter section 10*a* of the air cleaner 10. In contrast the conventional technique in which, in order to expose the blow window 19, the lid member exclusively dedicated for the blow window is required to be removed separately from the removal of the cleaner covering 11. Accordingly, the blow work can be easily performed in conjunction with the maintenance of the filter section 10*a* in the air cleaner 10 and, therefore, the workability of the maintenance is increased. Also, the use of the lid member exclusively dedicated for the blow window is no longer necessary and, therefore, the number of component parts is reduced to make it possible to reduce the cost.

Since the engine 1 is in the form of a V-shaped two cylinder engine and the filter section 10*a* of the air cleaner is disposed between the two cylinder units 2 and 2, the distance between those two cylinder units 2 and 2 is reduced, and, therefore, compactization of the cleaner covering 11 having the closing section 21 of the blow window 19 can be accomplished.

Since the blow window shown in FIG. 4 is formed one in number so as to confront the respective cylinder unit 2, the blow work effective for each cylinder unit 2 can be enabled. Also, where as the blow window 19 only one common window is formed so as to confront both of the cylinder units 2 and 2, the surface area occupied by the blow window 19 becomes large thereby to accompany the reduction in strength of the housing 13. In contrast thereto, if the blow window 19 is so formed as to confront each cylinder unit 2, the surface area occupied by the blow window 19 becomes relatively small and, therefore, the strength of the housing 13 is no longer reduced.

In this engine 1, the engine rotary shaft 9 shown in FIG. 1 extends vertically and the two cylinder units 2 and 2 are disposed horizontally. Accordingly, the blow work can be accomplished from above and the workability increases therefore.

The cleaner covering 11 is fitted to the housing 13 by means of the fastener 20 shown in FIG. 2, and this fastener 20 has the engagement portion 20D, as shown in FIG. 9, which is in turn engaged with the to-be-engaged portion 27 in the housing 13 shown in FIG. 6 when the fastener 20 is turned the predetermined angle in a condition having been inserted into the insertion hole 24 in the cleaner covering 11. Accordingly, removal of the cleaner covering 11 from the housing 13 shown in FIG. 2 is facilitated.

The to-be-engaged portion 27 of the housing 13 has, as shown in FIG. 10, defined therein the engagement recess 37, into which the engagement portion 20D of the fastener 20 climbs over the heap portion 36 and is trapped into a lock position upon the turn of the fastener 20, and the stoppers 28A and 28B for inhibiting the turn of the engagement portion any longer. Accordingly, the fitting of the cleaner covering 11 by means of the fastener 20 can be stabilized.

The closing section 21 of the cleaner covering 11 has the mounting protrusion 33, shown in FIG. 8, which is engaged with the blow window 19 in the housing 13. By the engagement between the blow window 19 and the mounting protrusion 33, the positioning of the cleaner covering 11 relative to the housing 13 can be facilitated and, therefore, the fitting of the cleaner covering 11 relative to the housing 13 is eased.

The air cleaner 10 shown in FIG. 2 can be removed in a separating direction of the cleaner covering 11, that is, upwardly thereof while the cleaner covering 11 has been separated. In general, since no obstruction exist in the separating direction of the cleaner covering 11, the air cleaner 10 can be easily removed in the same direction as the separating direction and the work of replacement of the filter section 10*a* can be facilitated accordingly.

As shown in FIG. 3, the marking 23 indicative of the blow window 19 is applied to the outer surface of the closing section 21. Since the marking 23 provides a visual indication that can be easily ascertained from the outside, the position of the blow window 19 can be instantaneously ascertained from the outside when the marking 23 is viewed and, hence, the blow work subsequent to the removal of the cleaner covering 11 can be eased.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, although in describing the preferred embodiment of the present invention reference has been made to the V-shaped two cylinder engine, the present invention can be equally applied to an opposed type two cylinder engine and any engine such as, for example, a single cylinder engine or an engine having three or more cylinders.

Accordingly, such changes and modifications are, unless they depart from the scope of the present invention as delivered from the claims annexed hereto, to be construed as included therein.

REFERENCE NUMERALS

1 . . . General purpose engine
2 . . . Cylinder unit
2*a* . . . Cylinder
2*b* . . . Cylinder head
4 . . . Cooling fin
7 . . . Crankcase
10 . . . Air cleaner
10*a* . . . Filter section
11 . . . Cleaner covering
12 . . . Shroud
13 . . . Housing
16 . . . Fan covering
19 . . . Blow window
20 . . . Fastener
20D . . . Engagement portion
21 . . . Closing section
23 . . . Marking
25 . . . Mounting hole
27 . . . To-be-engaged portion
28A, 28B . . . Stopper
33 . . . Mounting protrusion
37 . . . Engagement recess
40 . . . Gap
FA . . . Cooling fan

What is claimed is:

1. An air cooled general purpose engine in the form of a V-shaped two cylinder engine having two separate cylinder units with a filter section for an air cleaner disposed between the two cylinders in a recess of a fan housing located between a pair of blow windows in the fan housing, each blow window is positioned to overlap a separate cylinder unit adjacent cooling fins provided on each cylinder unit wherein an air cleaner covering extends over the blow windows in the fan housing and can be removably fastened to the fan housing.

2. The general purpose engine as claimed in claim 1, in which the general purpose engine is in the form of a V-shaped two cylinder engine having two separate cylinder units, the filter section of the air cleaner being disposed between the two cylinder units.

3. The general purpose engine as claimed in claim 2, in which a separate blow window is formed in the fan housing for each of the two cylinder units so as to confront cooling fins on a respective cylinder unit.

4. The general purpose engine as claimed in claim 2, in which an engine rotary shaft extends vertically and the two cylinder units are disposed horizontally.

5. The general purpose engine as claimed in claim 1, in which the air cleaner covering is fitted to the fan housing by means of a fastener, the fastener comprising an engagement portion which is engaged with a to-be-engaged portion of the fan housing when, in a condition having been inserted in the air cleaner covering, the fastener is turned a predetermined angle.

6. The general purpose engine as claimed in claim 5, in which the to-be-engaged portion of the fan housing is made up of an engagement recess, where a turn of the fastener causes an engagement portion of the fastener to climb over and be accommodated at a lock position, and a stopper to inhibit the turn of the engagement portion further beyond the lock position.

7. The general purpose engine as claimed in claim 1, in which the filter section is capable of being removed in a separating direction of the air cleaner covering when the air cleaner covering has been separated.

8. The air cooled general purpose engine of claim 1 wherein rotatable fasteners are provided and one rotatable fastener can be inserted into an opening adjacent each blow window to attach the air cleaner covering to the fan housing.

* * * * *